US007204736B2

(12) United States Patent
Chueh et al.

(10) Patent No.: US 7,204,736 B2
(45) Date of Patent: Apr. 17, 2007

(54) PRINTING SCREEN WITH IMPROVING SIDE-BOTTOM RATIO

(75) Inventors: Chuang-Chun Chueh, Taipei County (TW); Su-Chiu Lee, Taipei County (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 202 days.

(21) Appl. No.: 10/905,193

(22) Filed: Dec. 21, 2004

(65) Prior Publication Data

US 2006/0113884 A1 Jun. 1, 2006

(51) Int. Cl.
*H01J 9/12* (2006.01)

(52) U.S. Cl. ..... 445/24

(58) Field of Classification Search ..... 445/23–25
See application file for complete search history.

(56) References Cited

U.S. PATENT DOCUMENTS 7,045,944 B2 * 5/2006 Ushifusa et al. ..... 313/489

* cited by examiner

*Primary Examiner*—Joseph Williams
(74) *Attorney, Agent, or Firm*—Jianq Chyun IP Office

(57) ABSTRACT

A printing screen, printing process and method for improving side-bottom ratio are provided. The printing screen mainly comprises a plurality of printing units, wherein each of the printing units comprises a body and a protrusion structure. The body has an ink aperture, and the protrusion structure extends from a surface of the body into the ink aperture. The printing process of a fluorescent layer in a plasma display panel utilizing the said printing screen can enhance the uneven film thickness of the fluorescent layer on the bottom of a discharge chamber, and further improve the side-bottom ratio of the fluorescent layer in a plasma display panel.

17 Claims, 5 Drawing Sheets

PRINTING SCREEN WITH IMPROVING SIDE-BOTTOM RATIO

BACKGROUND OF THE INVENTION

1. Field of the Invention

The present invention relates to a printing screen and a printing process using the same. More particularly, the present invention relates to a method for improving a side-bottom ratio of a fluorescent layer in a plasma display panel and the printing screen used.

2. Description of Related Art

In recent years, with the rapid advancement of microelectronics technology, the information, communication, network technology and the relative industry have also developed. With that trend, the display apparatus, showing words, data, pictures and moving images, has become an indispensable element. Wherein, the plasma display apparatus, with its advantages such as big size, self-luminescence, wide view angle, thinness and full colors, has a great potential of becoming the mainstream flat panel display apparatus in its next generation.

FIG. 1 is a three-dimensional view of a decomposed conventional plasma display panel. As shown in FIG. 1, plasma display panel 100 mainly comprises a front substrate 110, discharge gas (not shown) and a rear substrate 120. The front substrate 110 mainly comprises a substrate 10, an X electrode and a Y electrode, wherein the X and Y electrodes are disposed on the substrate 10 and are covered with a dielectric layer 111 and a protection layer 12. The rear substrate 120 comprises a substrate 20, an address electrode 15, a dielectric layer 17, a rib 30 and a fluorescent layer 21, wherein the substrate 20 is divided into a plurality of discharge chambers 13 by the rib 30. The discharge gas in the plasma display panel 100 is disposed in the discharge chambers 13.

Following the preceding paragraph, the fluorescent layer 21 is disposed over the side wall of the rib 30 and over the dielectric layer 17. When the drive voltage is provided by the X, Y electrodes and the address electrode 15, the discharge gas in the discharge chambers 13 will be transformed into plasma and emit ultraviolet. When the fluorescent layer 21 is irradiated by the ultraviolet, it will emit visible light, whereby the plasma display panel 100 displays images. It can be learned from the foregoing that the thickness and the coating area of the fluorescent layer 21 over the side wall of the rib 30 and over the dielectric layer 17 have great impact on the luminescent efficiency of the plasma display panel 100.

FIG. 2 is a cross sectional view showing a fluorescent layer disposed into a discharge chamber in a conventional printing process. FIG. 3 is a top view of a printing screen used in the conventional printing process of FIG. 2. As shown in FIG. 3, when the printing process of the fluorescent layer 21 is performed, the printing screen with a corresponding shape of the discharge chamber is required. For example, in the plasma display panel 100 (as shown in FIG. 1), the grid-shaped printing screen 300 is used (as shown in FIG.3), because the fluorescent material is disposed into a grid-shaped discharge chamber 13.

As shown in FIGS. 2 and 3, the printing screen 300 is disposed over the rib 30 with each of the ink apertures 302 aligned with each of the discharge chambers 13 during the fabricating process of the fluorescent layer. Next, a fluorescent material, ink liquid 202, is coated over the printing screen 300 when the ink liquid 202 is scraped into the discharge chambers 13 by a scraper through the ink aperture 302 of the printing screen 300. And then in the baking process, the fluorescent layer 21 (as shown in FIG. 1) is formed over the side wall of the rib 30 and over the substrate 20.

In FIG. 2, when the fluorescent ink liquid 202 flows through the ink aperture 302 into the discharge chamber 13, the fluorescent ink liquid 202 first touches the side wall of the rib 30 and then gradually flows into the bottom of the discharge chamber 13. Therefore, the gas 310 in the bottom of the discharge chamber 13 can not be emitted and is enveloped in the fluorescent layer 21. As a result, after the baking process, the fluorescent layer 21 formed in the bottom of the discharge chamber 13 will have uneven film thickness. In other words, the fluorescent layer 21 will not have a good side-bottom ratio, the ratio referring to the thickness ratio of the fluorescent layer 21 to the side wall of the discharge chamber 13. Consequently, the luminescent efficiency of the plasma display apparatus will downgrade.

SUMMARY OF THE INVENTION

Accordingly, the present invention is directed to a printing screen capable of enhancing even thickness of the fluorescent layer during a printing process.

The present invention is also directed to a printing process capable of forming a fluorescent layer with more even thickness.

The present invention is also directed to a method for improving a side-bottom ratio so that a fluorescent layer in a discharge chamber has more even thickness and accordingly, the plasma display apparatus can have better luminescent efficiency.

According to an embodiment of the present invention, a printing screen adapted for a printing process of a fluorescent layer in a plasma display panel is provided. The printing screen comprises a plurality of printing units, and each of the printing units comprises a body and a protrusion structure. Wherein, each body has an ink aperture. The protrusion structure extends from a surface of the body into the ink aperture.

According to one embodiment of the present invention, each protrusion structure of each printing unit comprises a first protrusion and a second protrusion, wherein the ink apertures can be of a quadrangular shape. In each of the printing units, the first protrusion and the second protrusion are respectively connected to two neighboring side edges of the quadrangular ink aperture. In another embodiment, the first protrusion and the second protrusion are respectively connected to two opposite side edges of the quadrangular ink aperture. In addition, the shape of the ink apertures can also be rectangular and the aforementioned opposite side edges can be the two short sides of the rectangular ink aperture. Wherein, the positions of the first protrusion and the second protrusion of each printing unit can be symmetric. In another embodiment, the positions of the first protrusion and the second protrusion can be asymmetric.

According to one embodiment of the present invention, the protrusion structure of each printing unit comprises a plurality of first protrusion and a plurality of second protrusion, wherein the ink aperture can be of a quadrangular shape. In each of the printing units, the first protrusions and the second protrusions are respectively connected to two neighboring side edges of the quadrangular ink aperture. In another embodiment, the first protrusions and the second protrusions are respectively connected to two opposite side edges of the quadrangular ink aperture. Additionally, the ink aperture can be of a rectangular shape, and the said opposite side edges can be the two short sides of the rectangular ink aperture. Wherein, in each printing unit, the positions of the first protrusions and the second protrusions in each printing unit are symmetric. In another embodiment, the positions of the first protrusions and the second protrusions can be asymmetric. Additionally, in each printing unit, an area ratio of the protrusions to the ink aperture can be between 0.056:1 to 0.120:1.

According to an embodiment of the present invention, a printing process utilizing the said printing screen and a plurality of chambers is disclosed. The printing screen is disposed over the chambers with the ink apertures aligned with the chambers. And then the ink liquid is coated on the printing screen while the ink liquid flows into the chambers through the ink apertures. In each of the chambers, a temporary gap is formed between a portion of the ink liquid and the side wall of the chamber, wherein the gap is under the protrusion.

According to one embodiment of the present invention, a method for improving a side-bottom ratio is provided. The method is adapted for improving the side-bottom ratio of a fluorescent layer in a plasma display panel, wherein the plasma display panel comprises a plurality of discharge chambers besieged by a rib. The method for improving a side-bottom ratio starts by providing the aforementioned printing screen. Next, the printing screen is disposed over the rib with the ink apertures aligned with the discharge chambers. And then a fluorescent material is applied onto the printing screen when the fluorescent material flows into the discharge chambers through the ink apertures. In each of the discharge chambers, a temporary gap is formed between a portion of the fluorescent material and the side wall of the discharge chamber, wherein the gap is under the protrusion. Next, a drying process is performed whereby the fluorescent layer is formed on the bottom and the side wall of each discharge chamber. Wherein, the side-bottom ratio of the film thickness of the fluorescent layer in each discharge chamber can be between 1:2 to 2:1, and more preferably, the side-bottom ratio can be 1:1.

According to one embodiment of this invention, the drying process for the fluorescent material comprises a baking process.

To sum up, the present invention, the printing screen, the printing process and the method for improving side-bottom ratio, can be applied in a printing process of the fluorescent layer in a plasma display panel to improve the side-bottom ratio of the fluorescent layer in the discharge chamber and then eventually enhance the luminescent efficiency of the plasma display apparatus.

DESCRIPTION OF THE EMBODIMENTS

Various specific embodiments of the present invention are disclosed below, illustrating examples of various possible implementations of the concepts of the present invention. The following description is made for the purpose of illustrating the general principles of the invention and should not be taken in a limiting sense. The scope of the invention is best determined by reference to the appended claims.

The present invention provides a printing screen with protrusions in the ink apertures. The printing screen with protrusions enables the ink liquids to flow in different speeds to the same ink aperture. Therefore, the gas in the discharge chambers can be emitted from where the ink liquid flows in a slower speed, so as to avoid the uneven thickness of the fluorescent layer due to the gas enveloped in the ink liquids in the discharge chamber.

Figure 4:
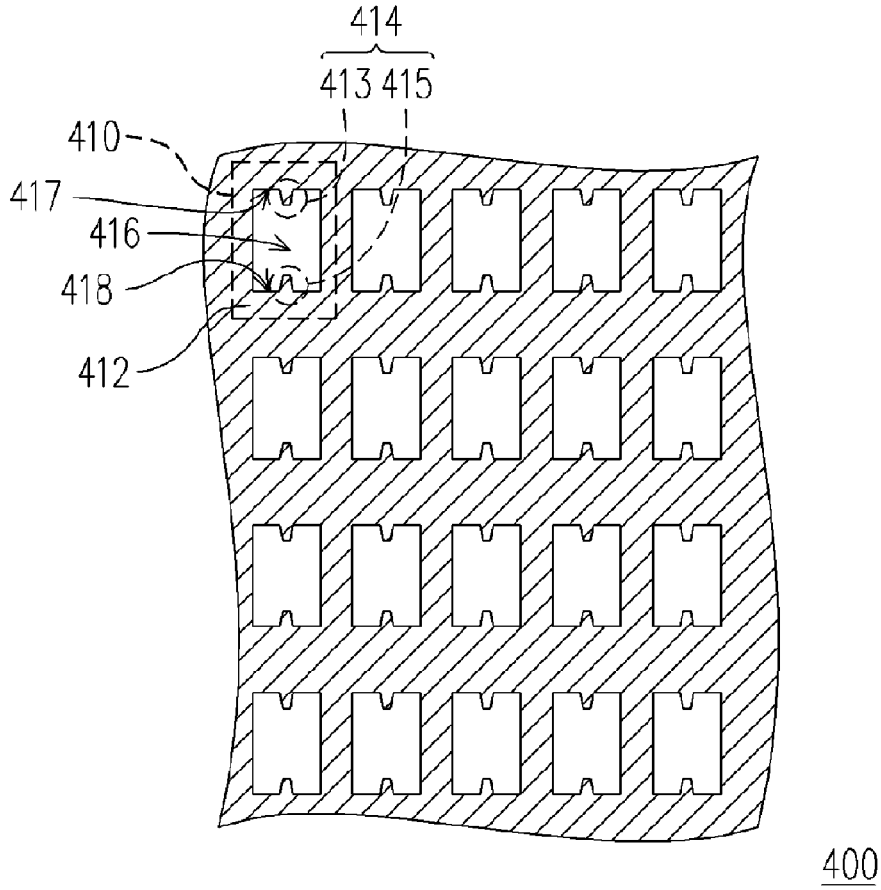
FIG. 4 is a top view of a printing screen according to one embodiment of the present invention.

FIG. 4 is a top view of a printing screen according to one embodiment of the present invention. As shown in FIG. 4, a printing screen 400 mainly comprises a plurality of printing units 410, wherein each of the printing units 410 comprises a body 412 and a protrusion structure 414. Each body 412 has an ink aperture 416, and the protrusion structure 414 extends from a surface of the body 412 into the ink aperture 416. The shape of the ink aperture 416 of the body 412 is dependent on the shape of discharge chambers. As shown in FIG. 4, for instance, if the printing screen 400 is used in the printing process of the fluorescent layer in a plasma display panel and the rib of the plasma display panel is a waffle structure, then the shape of the ink aperture 416 of the body 412 can be quadrangular, or rectangular in general. On the other hand, if the rib of the plasma display panel is a honeycomb structure, the shape of the ink aperture of the printing screen can be a hexagon (not shown). Thus the shape of the ink aperture 416 of the present invention is not limited, and persons skilled in the art can design the shape of the ink aperture 416 according to the requirement.

In one embodiment of the present invention, each of the protrusion structure 414 of each printing unit 410 comprises a first protrusion 413 and a second protrusion 415. As shown in FIG. 4, the first protrusion 413 and the second protrusion 415 are respectively connected to the side edges 417, 418 on the ink aperture 416. Wherein, the side edge 417 is opposite to the side edge 418 of the ink aperture 416, and the two side edges 417, 418 can be in the two short sides of the rectangular ink aperture 416. In other words, the first protrusion 413 and the second protrusion 415 are respectively connected to the two short sides of the rectangular ink aperture 416.

Figure 5:
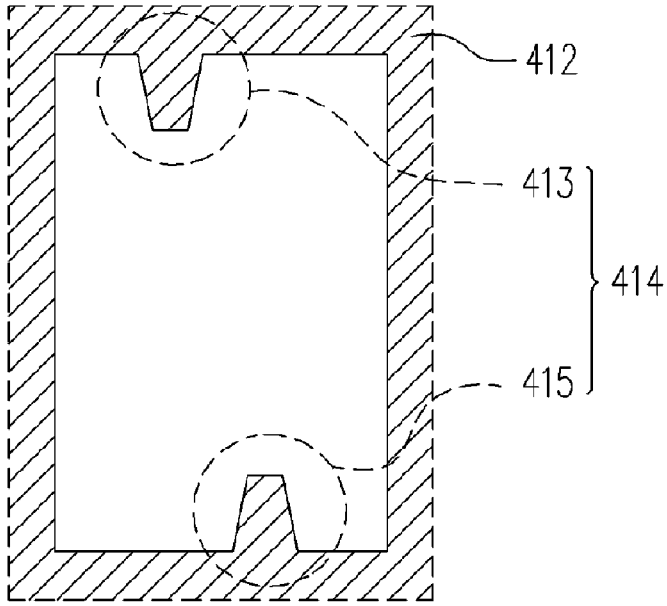
FIGS. 5 to 7 is a top view of a printing unit in a printing screen according to another embodiment of the present invention.
Figure 6:
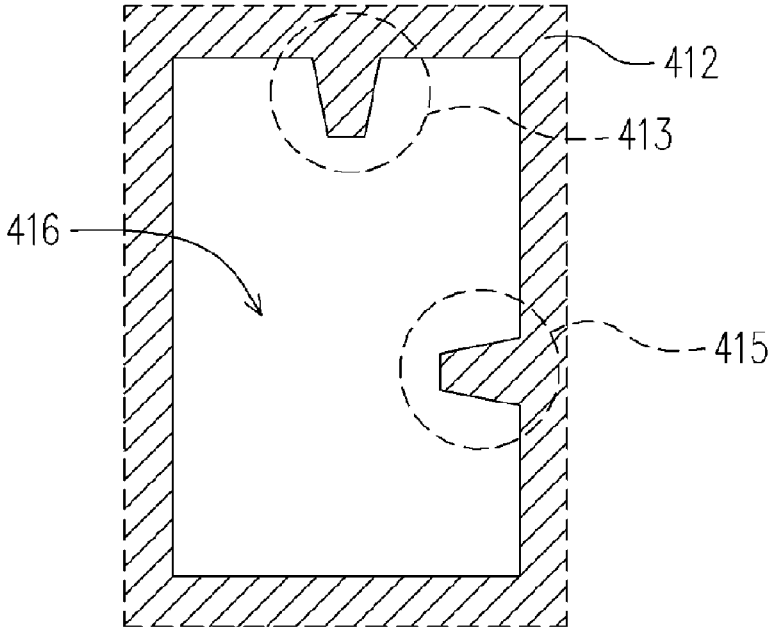

Furthermore, the positions of the first protrusion 413 and the second protrusion 415 can be symmetric (as shown in FIG. 4), or asymmetric (as shown in FIG. 5). Additionally, in another embodiment, the side edge 417 can be in the vicinity of the side edge 418 of the ink aperture 416; that is, the first protrusion 413 and the second protrusion 415 are respectively connected to the two neighboring side edges of the rectangular ink aperture 416 (as shown in FIG. 6).

It should be noted that the said protrusion structure 414 not only comprise a single first protrusion 413 and/or a single second protrusion 415, but also comprise a plurality of first protrusions 413 and/or a plurality of second protrusions 415. For instance, with reference to FIG. 7, in another embodiment of the present invention, each of the protrusion structure 414 of each printing unit 410 comprises two first protrusions 413 and two second protrusions 415. The first protrusions 413 are connected to the first vertical side edge 417*a* and the second vertical side edge 417*b* respectively on the ink aperture 416, wherein the first vertical side edge 417*a* is opposite to the second vertical side edge 417*b*. Additionally, the second protrusions 415 are connected to the first horizontal side edge 418*a* and the second horizontal side edge 418*b* respectively on the ink aperture 416.

Figure 7:
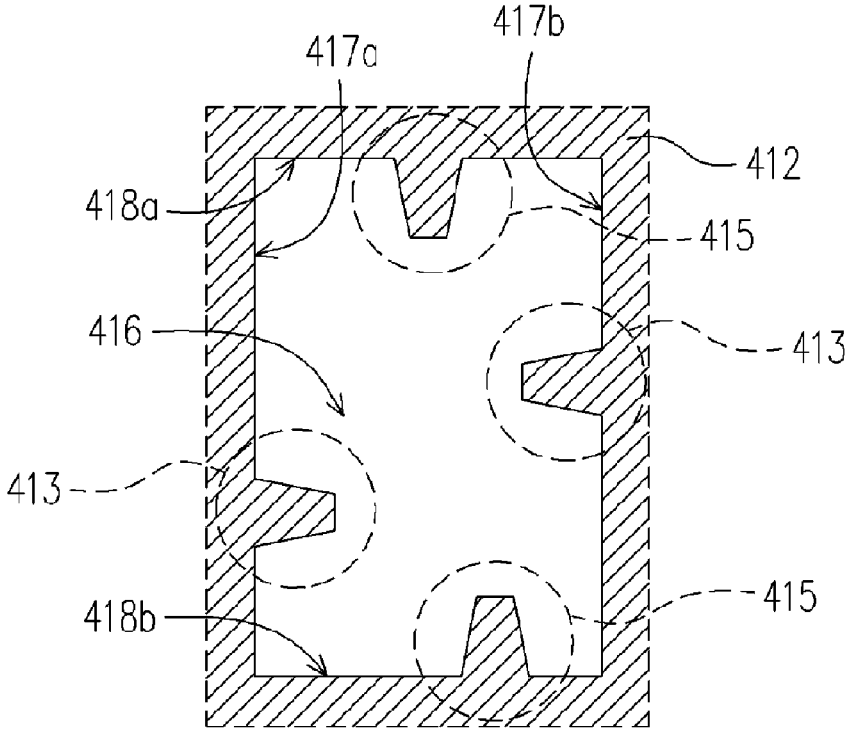

The positions of the said first protrusions 413 and/or the second protrusions 415 can be symmetric or asymmetric. However, in order not to affect the amount of the ink liquid flowing through the ink aperture 416, it is preferred that the positions of the first protrusions 413 and the second protrusions 415 are asymmetric (as shown in FIG. 7).

Please refer to FIG. 4. It should be noted that in order to compensate the area occupied by the protrusion structure 414 in the ink aperture 416 and to prevent a decreased amount of the ink liquid flowing into the ink aperture 416, the area of the ink aperture 416 in the present invention is slightly larger than that of the conventional printing screen in the same applicable field. But the area should still be within an acceptable range in the manufacturing process to avoid color mixing of the ink liquid in the printed object. For example, the area of each discharge chamber to be disposed with the ink liquid is 888 μm×325 μm, the area of each conventional ink aperture is 750 μm×200 μm, and the shape of each protrusion structure 414 in the present invention is a trapezoid whose area is 120 μm×150 μm. In order to avoid the said problem, the area of the ink aperture 416 in the present invention can be 750 μm×240 μm. In other words, the area ratio of the protrusion structure 414 to the ink aperture 416 of the present invention can be between 0.056:1 to 0.120:1.

It should be noted that the dimensions of the ink aperture 416 and the protrusion structure 414 shown in FIG. 4 are one parameter used in one embodiment of the present invention, which should not be used to limit any dimensions of the printing screen 400 in the present invention. Therefore, the dimensions, the numbers, and the shapes of the ink aperture and the protrusions of the printing screen 400 can be designed according to the actual requirement in the fabricating process, and are not limited by these embodiments.

The following example is a printing process for a fluorescent layer in a plasma display panel using the aforementioned printing screen. Additionally, it should be obvious from the foregoing embodiment that the printing screen of the present invention can be of various designs. Although the following embodiment takes the printing screen 400 as an example, other embodiments of the printing screen in the present invention can also be applied in the following statement, and are not limited to the printing screen shown in FIG. 4.

Figure 1:
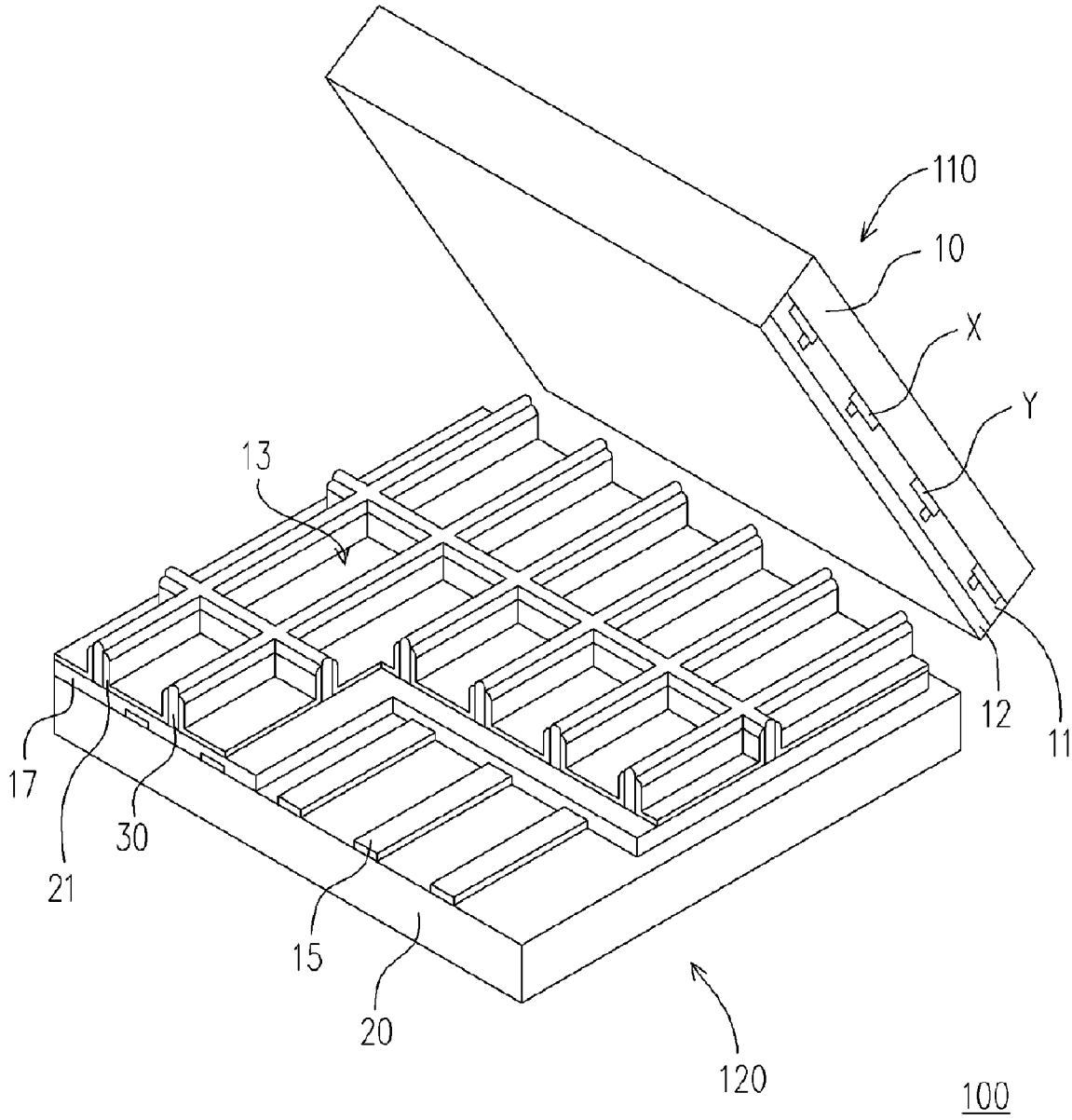
FIG. 1 (PRIOR ART)
FIG. 1 is a three-dimensional view of a decomposed conventional plasma display apparatus.
Figure 2:
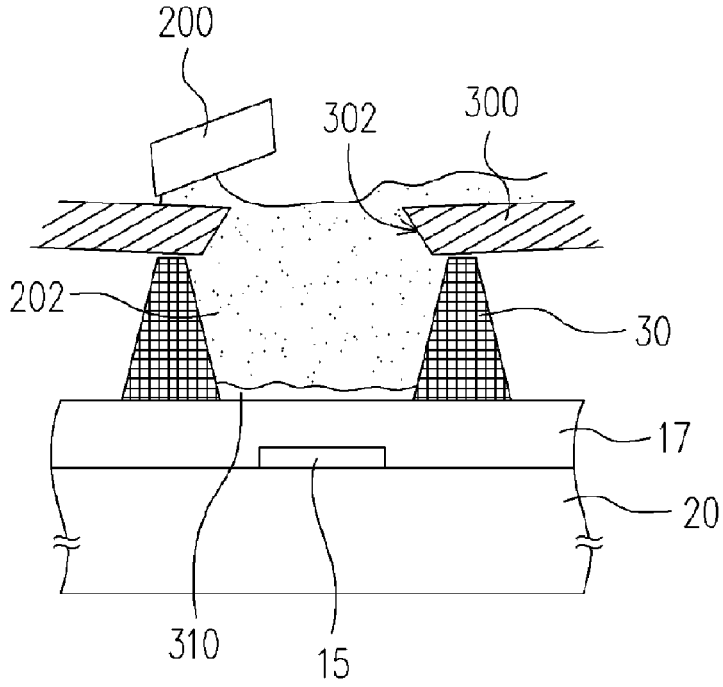
FIG. 2 (PRIOR ART)
FIG. 2 is a cross sectional view showing a fluorescent layer disposed into a discharge chamber in a conventional printing process.
Figure 8:
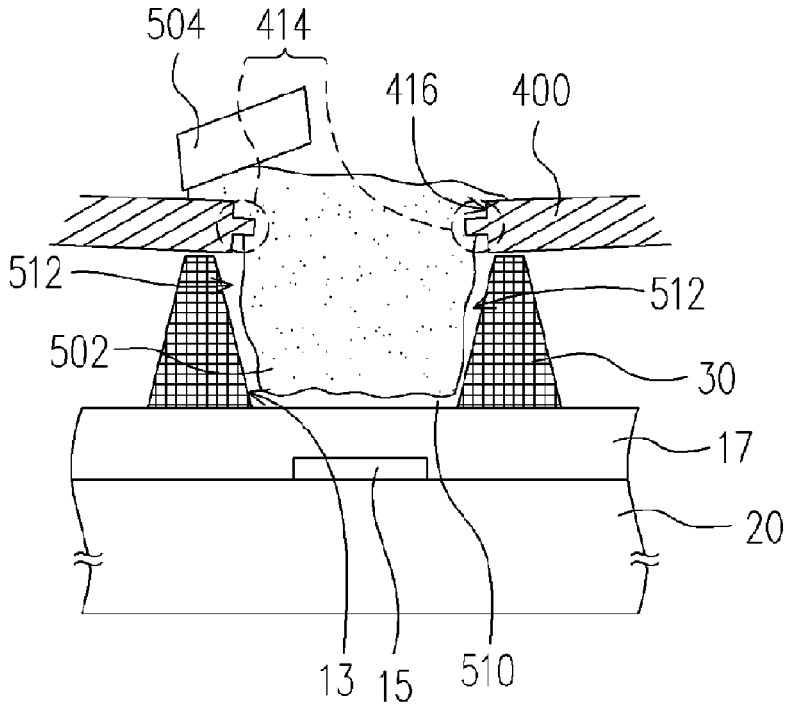
FIG. 8 is a cross sectional view of a printing process using a printing screen according to another embodiment of the present invention.

FIG. 8 is a cross sectional view of a fluorescent layer in a plasma display panel according to one embodiment of the present invention. The present embodiment illustrates a printing process of the fluorescent layer in the plasma display panel 100 shown in FIG. 1. Therefore, the plasma display panel formed in the present embodiment has the same structures with that shown in FIG. 1 except for the fluorescent layer. Thus, the identical components in FIGS. 1 and 8 will share the same mark in the following description.

As shown in FIG. 8, a printing screen of the present invention is provided, which can be the printing screen 400 shown in FIG. 4. Next, the printing screen 400 is disposed over the grid-shaped rib 30 with the ink aperture 416 aligned with the discharge chamber 13. Wherein, the quadrangular ink aperture 416 of the printing screen 400 can be arranged in a grid structure. If the rib 30 is of a honeycomb structure, the shape of the ink aperture 416 of the printing screen 400 can be a hexagon and arranged in a honeycomb structure.

And then the fluorescent material 502 is coated onto the printing screen 400 when the fluorescent material 502 flows in the discharge chamber 13 through the ink apertures 416. A scraper 504 is usually used in coating the fluorescent material 502 onto the printing screen 400.

It should be noted that partial area of the ink aperture 416 is occupied by the protrusion structure 414 of the printing screen 400. Therefore, while the fluorescent material 502 flows into the discharge chamber 13 through the ink aperture 416, the fluorescent material 502 first flows into the areas where the protrusion structure 414 is not disposed. And then a temporary gap 512 is formed in a portion of the discharge chamber 13 under the protrusion structure 414. Therefore, gas 510 in the bottom of the discharge chamber 13 can be emitted through the gap 512 (as shown in FIG. 8) to prevent the uneven thickness of the florescent material 502 due to the gas 510 enveloped in the bottom of the discharge chamber 13.

Figure 9:
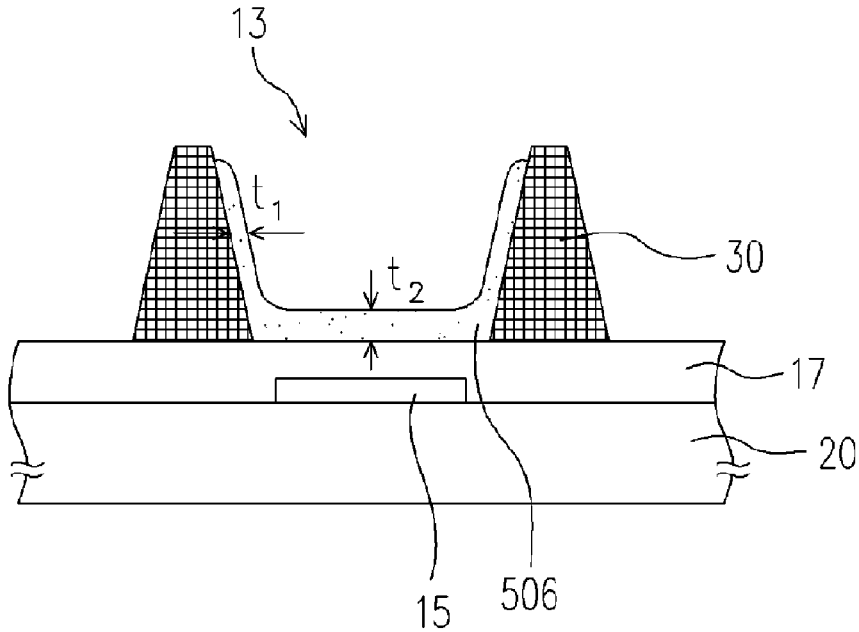
FIG. 9 is a cross sectional view of a rear substrate in a plasma display panel after finishing the printing process shown in FIG. 8.

Please refer to FIG. 9. In general procedures, a printing process of the florescent material is followed by a drying process, where the fluorescent material is baked so that a fluorescent layer 506 is formed on the bottom (i.e. the dielectric layer 17) and the side wall of the discharge chamber 13 (i.e. the side wall of the rib 30).

Figure 3:
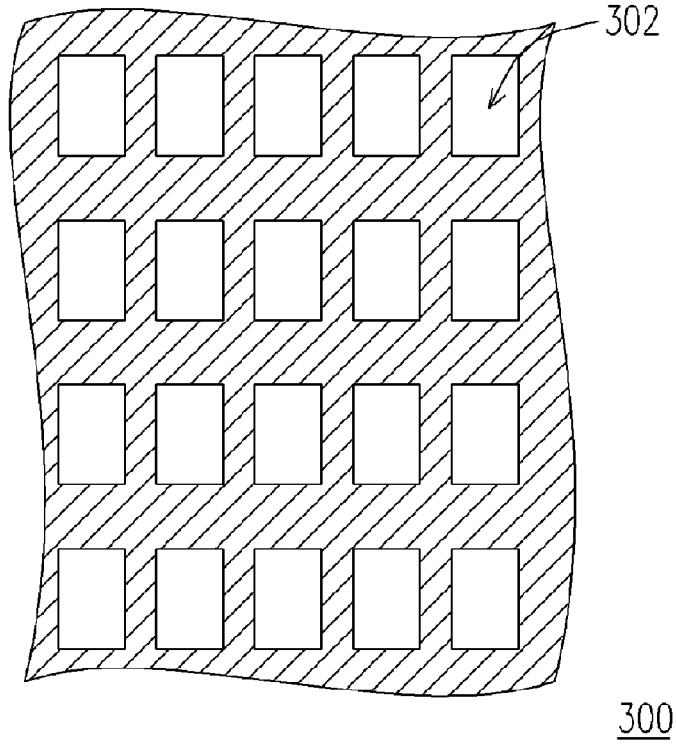
FIG. 3 (PRIOR ART)
FIG. 3 is a top view of the printing screen used in the printing process shown in FIG. 2.

According to the experiment data of the present invention, the thickness of the fluorescent layer 506 on the side wall of the discharge chamber 13 is thinner than that of the conventional apparatus. For instance, in one embodiment of the present invention, the thickness of the fluorescent layer formed on the side wall of the discharge chamber 13 when using the conventional printing screen 300 (as shown in FIG. 3) is 43.72 μm, whereas the average thickness t1 of the fluorescent layer 506 formed on the side wall of the discharge chamber 13 when using the printing process of the present invention is 40.24 μm. It can be observed that the present invention can not only enhance the even thickness of the fluorescent layer 506 on the bottom of the discharge chamber 13, but also reduce the thickness t1 of the fluorescent layer 506 on the side wall of the discharge chamber 13. Moreover, the film thickness t2 of the fluorescent layer 506 on the bottom of the discharge chamber 13 can be increased by the drying speed of the fluorescent layer 506. And then the side-bottom ratio of the film thickness of the fluorescent layer 506 in the discharge chamber 13 can be maintained between about 1:1 to about 1.5:1, wherein a preferable ratio is 1:1.

It should be noted that although the printing process for the fluorescent layer in a plasma display apparatus is cited as an example, the process can also be applied in other printing process, and not limited in the process of the present invention. It should be apparent to persons skilled in the art that the printing screen of the present invention can be applied in other printing processes and achieve the same effect of the aforementioned embodiments.

To sum up, the present invention has the following advantages:

1. In the present invention, the printing screen, the printing process and the method for improving side-bottom ratio, a temporary gap is formed in a portion of the discharge chamber under the protrusions when the ink liquid flows into the discharge chamber through the ink apertures. Therefore, the gas on the bottom of the chamber can be squeezed out by the ink liquid and is emitted outside the chamber through the gap while the ink liquid flows into the bottom of the chamber. Eventually, the uneven thickness due to the gas enveloped by the ink liquid can be reduced.

2. In the present invention, the printing screen, the printing process and the method for improving side-bottom ratio, the printing screen can be applied in the printing process of the fluorescent layer in the plasma display panel to improve the side-bottom ratio of the fluorescent layer in the discharge chamber. Hence, the luminescent efficiency of the plasma display apparatus can be promoted.

The above description provides a full and complete description of the embodiments of the present invention. Various modifications, alternate construction, and equivalent may be made by those skilled in the art without changing the scope or spirit of the invention. Accordingly, the above description and illustrations should not be construed as limiting the scope of the invention which is defined by the following claims.

What is claimed is:

1. A printing screen, adapted for a printing process of a fluorescent layer in a plasma display panel, wherein the printing screen comprises a plurality of printing units, and each of the printing units comprises:

a body having an ink aperture; and a protrusion structure extending from a surface of the body into the ink aperture.

2. The printing screen of claim 1, wherein each of the protrusion structure of each of the printing units comprises a first protrusion and a second protrusion.

3. The printing screen of claim 2, wherein a shape of the ink aperture comprises a quadrangle.

4. The printing screen of claim 3, wherein in each of the printing units, the first protrusion and the second protrusion are respectively connected to two neighboring side edges of the quadrangular ink aperture.

5. The printing screen of claim 3, wherein in each of the printing unit, the first protrusion and the second protrusion are respectively connected to two opposite side edges of the quadrangular ink aperture.

6. The printing screen of claim 5, wherein a shape of the ink aperture comprises a rectangle and the opposite side edges comprise two short sides of the rectangular ink aperture in each of the printing units.

7. The printing screen of claim 5, wherein the positions of the first protrusion and the second protrusion are symmetric.

8. The printing screen of claim 5, wherein the positions of the first protrusion and the second protrusion are asymmetric.

9. The printing screen of claim 1, wherein the protrusion structure of each of the printing units comprises a plurality of first protrusions and a plurality of second protrusions.

10. The printing screen of claim 9, wherein a shape of the ink aperture comprises a quadrangle, and each of the quadrangular ink aperture comprises a first vertical side edge, a second vertical side edge, a first horizontal side edge and a second horizontal side edge, and the first vertical side edge is opposite to the second vertical side edge and the first horizontal side edge is opposite to the second horizontal side edge.

11. The printing screen of claim 10, wherein a shape of the ink aperture comprises a rectangle.

12. The printing screen of claim 10, wherein in each of the printing units, some first protrusions are connected to the first vertical side edge of the rectangular ink aperture, other first protrusions are connected to the second vertical side edge of the rectangular ink aperture, while some second protrusions are connected to the first horizontal side edge of the rectangular ink aperture, and other second protrusions are connected to the second horizontal side edge of the rectangular ink aperture.

13. The printing screen of claim 12, wherein the positions of some first protrusions connected to the first vertical side edge of the rectangular ink aperture and other first protrusions connected to the second vertical side edge of the rectangular ink aperture are symmetric.

14. The printing screen of claim 12, wherein the positions of some first protrusions connected to the first vertical side edge of the rectangular ink aperture and other first protrusions connected to the second vertical side edge of the rectangular ink aperture are asymmetric.

15. The printing screen of claim 12, wherein the positions of some second protrusions connected to the first horizontal side edge of the rectangular ink aperture and other second protrusions connected to the second horizontal side edge of the rectangular ink aperture are symmetric.

16. The printing screen of claim 12, wherein the positions of some second protrusions connected to the first horizontal side edge of the rectangular ink aperture and other second protrusions connected to the second horizontal side edge of the rectangular ink aperture are asymmetric.

17. The printing screen of claim 1, wherein in each of the printing units, an area ratio of the protrusion structure to the ink aperture is between 0.056:1 to 0.120:1.

* * * * *